US005941750A

United States Patent [19]

Pracas

[11] Patent Number: 5,941,750

[45] Date of Patent: Aug. 24, 1999

[54] DOLL HAVING MAGNETICALLY ACTUATED FUNCTIONS

[75] Inventor: Victor Manuel Pracas, Waroona, Australia

[73] Assignee: Technovation Australia Pty. Ltd., Rockingham, Australia

[21] Appl. No.: 08/817,754

[22] PCT Filed: Oct. 30, 1995

[86] PCT No.: PCT/AU95/00725

§ 371 Date: Jul. 14, 1997

§ 102(e) Date: Jul. 14, 1997

[87] PCT Pub. No.: WO96/13313

PCT Pub. Date: May 9, 1996

[30] Foreign Application Priority Data

Oct. 31, 1994 [AU] Australia ..... PM 9130
Jul. 6, 1995 [AU] Australia ..... PN 4007

[51] Int. Cl.[6] ..... A63H 3/24

[52] U.S. Cl. ..... 446/130; 446/136; 446/305; 446/345

[58] Field of Search ..... 446/129, 130, 446/136, 137, 139, 305, 306, 345, 296

[56] References Cited

U.S. PATENT DOCUMENTS

| | | | |
|---|---|---|---|
| 2,505,626 | 4/1950 | Palmer | 446/130 |
| 3,383,793 | 5/1968 | Bonanno | 446/130 |
| 3,775,901 | 12/1973 | Ellman et al. . | |
| 4,413,441 | 11/1983 | Hunter et al. . | |
| 5,252,101 | 10/1993 | Rosenwinkel et al. | 446/130 |

FOREIGN PATENT DOCUMENTS

| | | | |
|---|---|---|---|
| 90124/82 | 5/1983 | Australia . | |
| 2575934 | 7/1986 | France | 446/130 |
| 1 206 425 | 9/1970 | United Kingdom . | |
| 2011264 | 12/1977 | United Kingdom . | |
| 2068245 | 8/1981 | United Kingdom | 446/305 |
| 2068753 | 8/1981 | United Kingdom | 446/305 |
| 2230200 | 10/1990 | United Kingdom | 446/305 |

*Primary Examiner*—Robert A. Hafer
*Assistant Examiner*—Jeffrey D. Carlson
*Attorney, Agent, or Firm*—Merchant & Gould, P.C.

[57] ABSTRACT

A baby doll (10) capable of simulating physiological functions of a human body in response to an applied magnetic field. The doll (10) has an internal reservoir (12) that can be filled with liquid through a mouth (14) of the doll. The internal reservoir (12) has an outlet (16) which is closable by a closure member (18). The closure member (18) is movable from a closed position in which the outlet (16) is closed, to an open position in which the outlet (16) is opened, in response to an applied magnetic field. A permanent magnet (40) is fixed to the closure member (18). A receptacle in the form of a cot (22) designed to receive the doll (10) in a recumbent position, is provided with a permanent magnet (20) therein, so that when the doll (10) is placed in the cot, a magnetic field can be applied to the magnet (40) on closure member (18) by the permanent magnet (20), so that outlet (16) is opened and liquid can flow from the reservoir (12) so the doll appears to have wet itself. The baby doll (10) is also provided with movable eyes (42) in the form of an eye socket (44) having an eyeball (46) pivotally mounted therein. A small permanent magnet forms a counterweight (48) provided on the rear of the eyeball (46). The small permanent magnet (48) is arranged so that when the doll is in a recumbent position and the eye (42) is normally closed, an applied magnetic field can overcome the force of gravity acting on the magnet (48) to cause the eyeball (46) to pivot to an open position.

14 Claims, 5 Drawing Sheets

DOLL HAVING MAGNETICALLY ACTUATED FUNCTIONS

FIELD OF THE INVENTION

The present invention relates to a baby doll capable of simulating physiological functions of a human baby in response to an applied magnetic field and relates particularly, though not exclusively, to a miniature baby doll having a receptacle designed to receive the doll in a recumbent position wherein the doll is capable of simulating a human baby wetting itself. The invention also relates to a magnetically actuated eye for a doll.

BACKGROUND TO THE INVENTION

Children in every culture enjoy playing with toy dolls. Typically a doll is used by the child in imaginative play to enable the child to imitate adult role models and/or play act fantasy roles. The doll is usually a passive participant in the play but fulfills an important role as it frees the child to relate in an adult way towards the doll without causing offense. In view of the important role dolls can have in the play of children, toy manufacturers have tried to incorporate additional features in toy dolls in order to enhance their play value. The play value of a toy is a measure of its ability to capture and maintain the interest and involvement of a child. The greater the play value, the longer a child will continue to play with and remain amused by the toy.

In recent years some toy manufacturers have produced dolls that can be fed liquid from a bottle and which also wet themselves as a result. However, the behaviour of such dolls is very predictable and the play value of the doll is not greatly enhanced since it is often unable to maintain the interest and involvement of the child. Furthermore, the internal mechanism that enables the doll to both ingest and excrete liquid is fairly bulky, and it has therefore not been possible to produce a miniature doll with similar features.

SUMMARY OF THE INVENTION

The present invention was developed with a view to providing a baby doll capable of simulating physiological functions of a human baby in response to an external magnetic field.

According to one aspect of the present invention there is provided a baby doll and a receptacle adapted to receive the doll in a recumbent position, the doll having an internal reservoir that can be filled with liquid through a mouth of the doll, said internal reservoir having an outlet which is closable by a closure member, said closure member being movable from a closed position to an open position in response to an applied magnetic field; and, the receptacle being provided with a magnetic field generating means whereby, in use, when the doll is placed in the receptacle and a magnetic field is applied to the closure member by the magnetic field generating means said outlet is opened so that the doll appears to have wet itself.

Preferably said magnetic field generating means is movable between a first position in which the magnetic field is not applied to the closure member and a second position in which the magnetic field is applied to the closure member. Advantageously an actuating mechanism is provided for automatically moving the magnetic field generating means from the first position to the second position within a certain time interval after the doll is placed in the receptacle.

Preferably, the receptacle is in the form of a cot.

Preferably the cot or the doll also includes sound generating means for producing a crying sound at more or less the same time as, or shortly after, the magnetic field generating means has moved to the second position whereby, in use, the doll appears to cry because it has wet itself. The doll is preferably provided with movable eyes that close when it is placed in a recumbent position, said eyes being adapted to open when a magnetic field is applied thereto whereby, in use, when the doll is placed in the cot and a magnetic field is applied to the eyes by the magnetic field generating means the doll also appears to wake up because it has wet itself.

It will therefore appear to a child that the baby doll is behaving in a way that is typical of a human baby and that demands the attention and involvement of the child playing with the doll. The doll is able to be fed by bottle and retains the liquid within the reservoir until some time after it is placed in the cot. It then appears to urinate, starts crying and wakes up. The child has left the doll dry and sleeping in its cot and then finds it awake and crying, and needing a change. This simulated infant behaviour invites the child's emotional and active involvement with the doll and may arouse the innate maternal/paternal instincts of the child.

In a preferred embodiment said actuating mechanism comprises a clockwork motor that is typically wound-up by pulling on a pull cord and which unwinds within a predetermined time interval, towards the conclusion of which it moves the magnetic field generating means from the first position to the second position. Preferably a switch is provided for activating said clockwork motor when the doll is placed in the receptacle in a recumbent position.

According to another aspect of the present invention there is provided a movable eye for a doll, of the type that opens when the doll is in an upright position and that closes when it is placed in a recumbent position, the eye comprising:

an eye socket having an eyeball pivotally mounted therein; and, a magnetic means mounted on the eyeball whereby, when the doll is in a recumbent position in which the eye is normally closed, an applied magnetic field can cause the eyeball to pivot to an open position.

Preferably said magnetic means is a small permanent magnet that also acts as a counterweight which, in the absence of an applied magnetic field, causes the eyeball to pivot to a closed position under the force of gravity when the doll is in a recumbent position.

Preferably said eye socket and eyeball are made from plastics or other non-metallic materials so as to avoid shielding said magnetic means from an applied magnetic field.

Advantageously said applied magnetic field is generated by a permanent magnet which may be brought into close proximity to the head of the doll. For example, the permanent magnet may be mounted in a hand-held mirror or in a toy baby bottle so that when the mirror or baby bottle is brought into close proximity to the doll's face the eyes open if the doll is in a recumbent position.

Once again, by fitting a doll with eyes according to the invention the attention and involvement of a child playing with the doll is encouraged because of the doll's apparent responsiveness to the actions of the child in relation to the doll. This human-like behaviour of the doll greatly enhances the play value of the doll as it enables the child to play-act familiar behavioural patterns whilst retaining total control of the situation.

BRIEF DESCRIPTION OF DRAWINGS

In order to facilitate a better understanding of the nature of the invention a preferred embodiment of the doll, receptacle and eye will now be described in detail, by way of example only, with reference to the accompanying drawings, in which.

DETAILED DESCRIPTION OF PREFERRED EMBODIMENT

Figure 1:
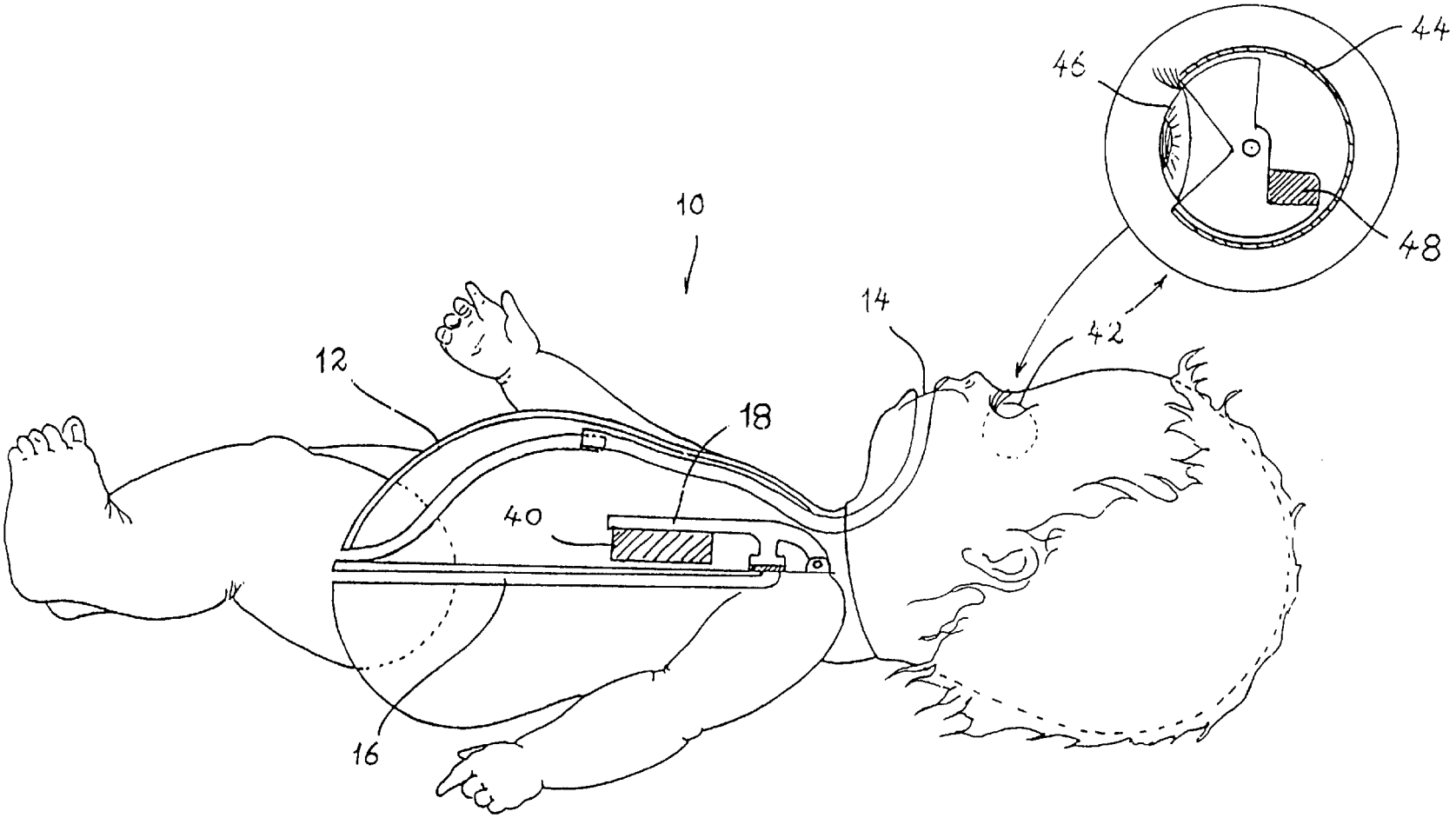
FIG. 1 is a side view of a preferred form of baby doll showing an internal reservoir and an enlarged partial section view of an eye.

FIG. 1 illustrates a preferred embodiment of the baby doll 10 which has an internal reservoir 12 that can be filled with liquid through a mouth 14 of the doll. The doll illustrated in FIG. 1 is of the miniature kind and is shown larger than life, being in reality only approximately 15 centimetres from head to toe. The internal reservoir 12 has an outlet 16 which is closable by a closure member 18. The closure member 18 is movable from a closed position in which the outlet 16 is closed, to an open position in which the outlet 16 is opened, in response to an applied magnetic field. The closure member 18 is shown in broken outline in FIG. 2 in the open position due to the action of a magnetic field applied by a magnetic field generating means in the form of a permanent magnet 20 (see FIGS. 5 and 6).

Figure 4:
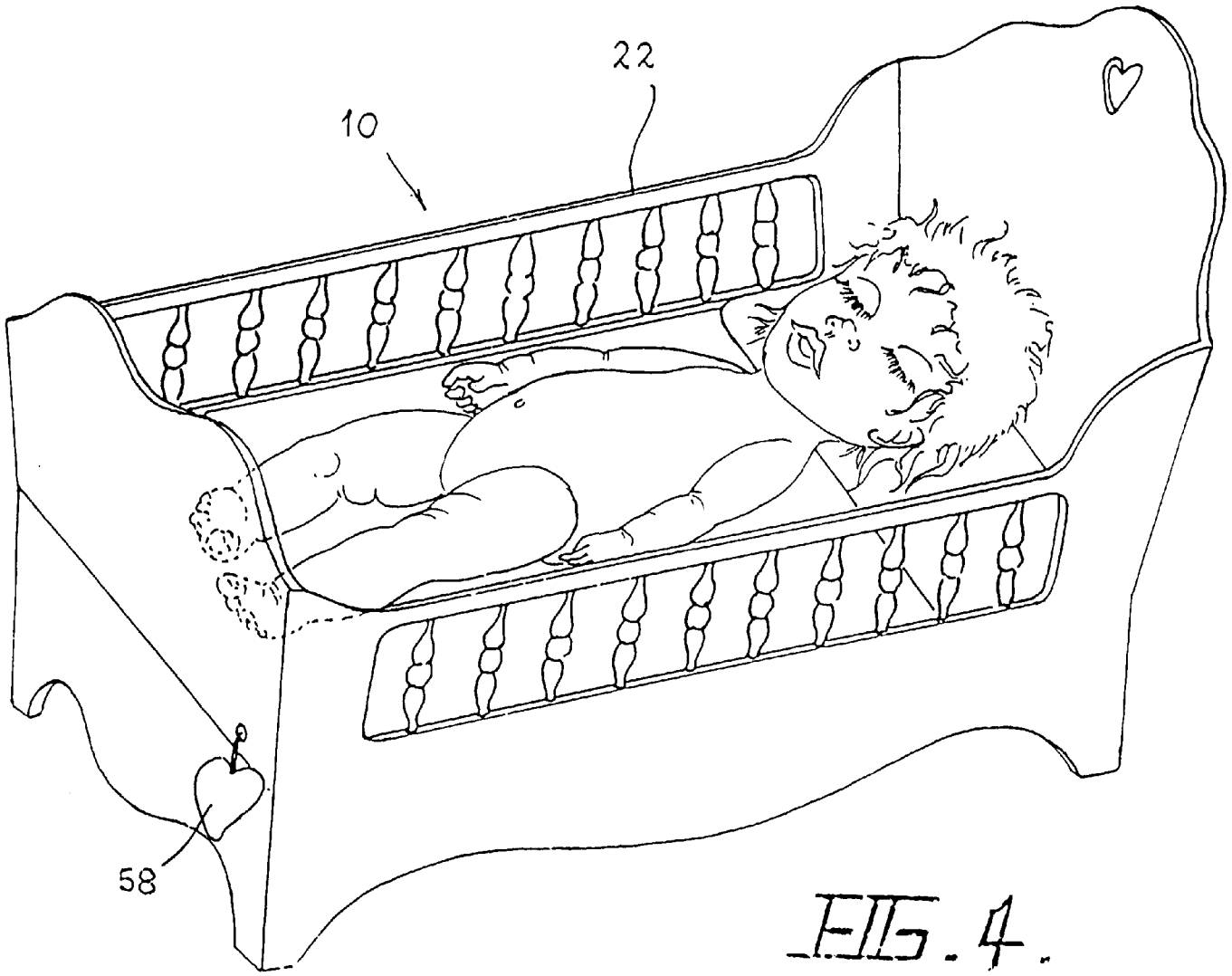
FIG. 4 is a perspective view of a preferred form of receptacle for the doll, in the form of a cot.
Figure 5:
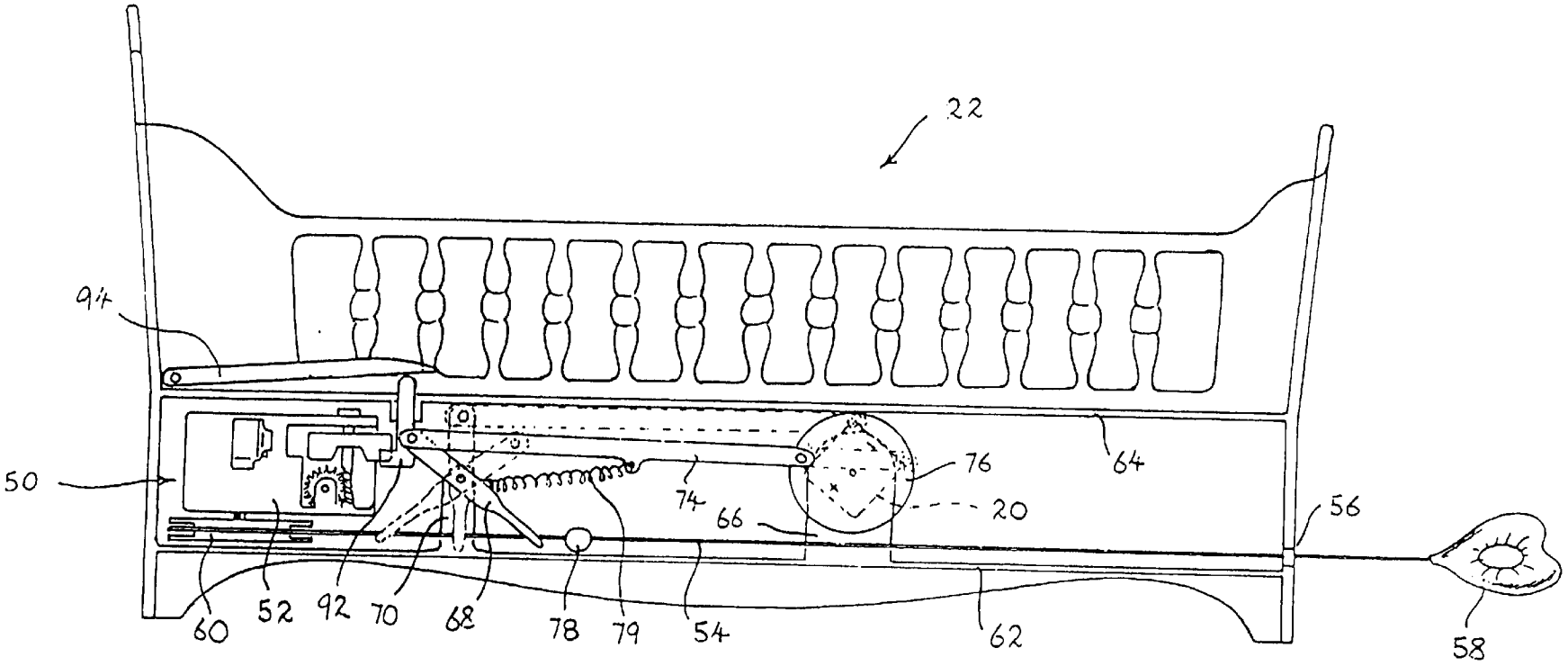
FIG. 5 is a side partial section view of the cot of FIG. 4 with the doll removed; and, FIG. 6 is a perspective view of a preferred form of magnetic field generating means and actuating mechanism located in the base of the cot shown in FIGS. 4 and 5.

The permanent magnet 20 is provided within a cot 22, (adapted to receive the doll 10 in a recumbent position) as illustrated in FIG. 5. When the doll is placed in the cot as illustrated in FIG. 4, and a magnetic field is applied to the closure member 18 by the permanent magnet 20, the outlet 16 is opened so that liquid can flow from the reservoir 12 so the doll appears to have wet itself.

Figures 2, 3:
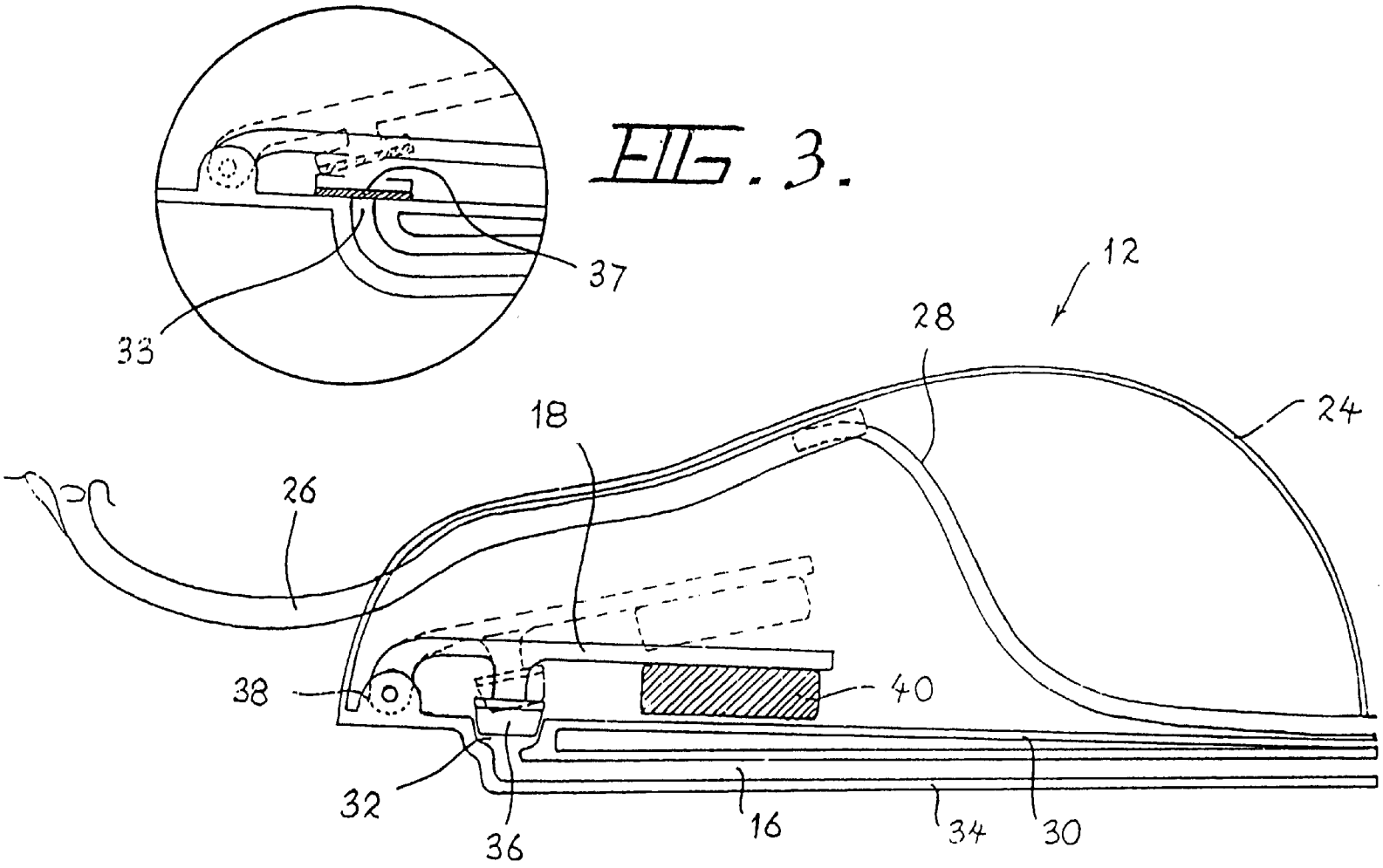
FIG. 2 is an enlarged section view of a preferred form of internal reservoir used in the doll of FIG. 1.
FIG. 3 is an enlarged section view of an alternative plug for the internal reservoir of FIG. 2.

FIG. 2 is an enlarged section view through the internal reservoir 12, which comprises a container 24 moulded to conform to the internal shape of the torso of the doll 10. Container 24 has an enlarged portion corresponding to the belly of the doll and a smaller portion corresponding to the chest of the doll. A flexible hollow tube 26 extends from the mouth of the doll into the container 24 and terminates in the region of largest circumference within the enlarged portion of the container 24. Hence, when the doll is in a recumbent position as shown in FIG. 1, the level of liquid within the container 24 is generally below the end of the tube 26 so that the liquid does not flow back through the tube 26 in the recumbent position. A smaller hollow tube 28 provided within the container 24 also terminates in the general region of the end of flexible tube 26, and extends downwards to exit from container 24 in the region of the crotch of the doll. Tube 28 is designed to allow displaced air to escape from the interior of container 24 as liquid enters via the flexible tube 26. Tube 28 is of sufficiently small internal diameter that liquid will not normally escape therethrough from the interior of container 24.

Container 24 also comprises a substantially planar wall 30 which lies adjacent the internal surface of the back of the doll 10. Outlet 16 comprises a circular aperture 32 in the wall 30 and a small rigid tube 34 that extends from the aperture 32 to the crotch of the doll 10. Closure member 18 includes a plug 36 adapted to seal aperture 32 in the closed position of the closure member 18 as shown in FIG. 2. Closure member 18 is pivotally connected at one end to the wall 30 at pivot point 38, and is provided with a small permanent magnet 40 fixed to its opposite end. The respective polarities of the permanent magnets 20, 40 are arranged so that when they are brought into close proximity they repel each other causing closure member 18 to pivot upwards so that plug 36 no longer seals the aperture 32. Any liquid present in the container 24 can then drain out through aperture 32 and tube 34 of the internal reservoir 12.

In the embodiment of FIG. 2 aperture 32 is enlarged so as to receive plug 36 therein in sealing relationship. Plug 36 is typically made from a resilient plastics material or rubber. FIG. 3 illustrates an alternative form of plug 37 for sealing an aperture 33 for tube 34 of the internal reservoir 12. In this embodiment, the plug 37 lies flush against the wall 30 in the closed position to seal aperture 33.

Aperture 32 is arranged in the wall 30 as close as possible to that end of the container 24 which is uppermost (within the chest region of the doll), when the doll is held in a generally upright position. Hence, the location of aperture 32 is generally above the level of liquid within the container 24 when the doll is held in an upright position. Furthermore, pivot point 38 is located so that closure member 18 is normally held in the closed position by the force of gravity acting on the closure member 18. The weight of permanent magnet 40 helps to keep the closure member 18 in the closed position, with plug 36 sealing aperture 32. If the doll 10 is placed in a recumbent position facing down, closure member 18 will fall to the open position under the force of gravity. However, any liquid within the container 24 will also fall away from the wall 30 and therefore cannot escape through aperture 32. A small amount of liquid may escape, in this position of the doll, through tube 26. Hence, it will be appreciated that once liquid has been ingested by the doll very little liquid can escape from the internal reservoir 12 without the application of an external magnetic field. This allows a child to play with the doll in a normal manner subsequent to feeding without fear of the liquid escaping prematurely.

The baby doll 10 is preferably provided with movable eyes 42 that are open when the doll is in an upright position and that close when it is placed in a recumbent position. An eye 42 of this type is generally known and an improved version thereof is illustrated in the enlargement in FIG. 1. The eye 42 comprises an eye socket 44 having an eyeball 46 pivotally mounted therein. A small counterweight 48 is provided on the rear of the eyeball 46 and causes the eyeball 46 to tend to remain in a horizontal orientation due to the force of gravity even when the orientation of eye socket 44 is changed. In this improved version, counterweight 48 is in the form of a small permanent magnet arranged so that when the doll is in a recumbent position and the eye 42 is normally closed, an applied magnetic field can overcome the force of gravity acting on the magnet 48 to cause the eyeball 46 to pivot to an open position. Hence, when the doll 10 is placed in the cot 22 in a recumbent position and a magnetic field is applied to the eyes 42 by the permanent magnet 20, the doll appears to wake up as its eyes are caused to open.

Preferably, the permanent magnet 20 is movable between a first position in which the magnetic field is not applied to the closure member or eyes 42, and a second position in which the magnetic field is applied either simultaneously or sequentially to the closure member and the eyes 42. In order to move the permanent magnet 20 from the first position to the second position within a certain time interval after the doll is placed in the cot 22, an actuating mechanism 50 is provided within the cot 22 as shown in FIG. 5. Actuating mechanism 50 will now be described in detail with reference to FIGS. 5 and 6.

Figure 6:
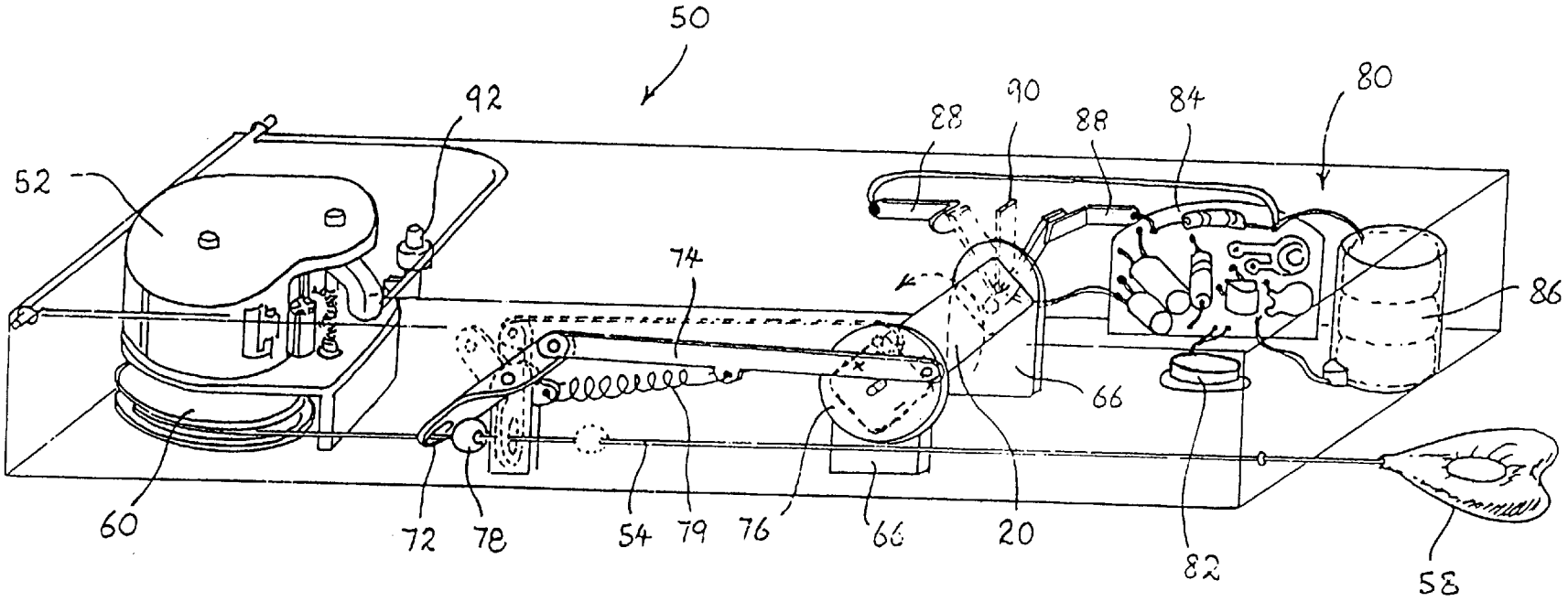

The actuating mechanism 50 as illustrated in FIGS. 5 and 6 comprises a clockwork motor 52 similar to the type of clockwork motor used in musical jewellery boxes and other music boxes. In this embodiment, the clockwork motor is wound-up by pulling on a pull cord 54 which extends through a hole 56 provided at a foot end of the cot 22 and terminates at a heart-shaped finger grip 58. The other end of the pull cord 54 is wound about a spool 60 provided on the spindle of the clockwork motor 52. Clockwork motor 52 is mounted on a base plate 62 of the actuating mechanism which also forms the base of the cot 22. A false bottom 64 of the cot 22 together with the base plate 62 forms a cavity within which the actuating mechanism 50 is hidden from view.

The permanent magnet 20 is pivotally mounted on first and second brackets 66 fixed to the base plate 62. In FIG. 5, the magnet 20 is shown in the first position in which the magnetic field is not applied to the doll 10 when placed in cot 22, whereas in FIG. 6 the magnet 20 is shown in the second position in which the magnetic field is applied to the doll in such a way as to open the closure member 18 and eyes 42 of the doll. The respective magnetic poles of the permanent magnet 20 are indicated by the symbols "+" and "−" respectively.

In FIG. 5 it will be seen that the positive pole of the permanent magnet 20 in the first position is facing downwards, whereas in FIG. 6 the positive pole of the permanent magnet in the second position is facing upwards. In order to move the permanent magnet 20 from the first position to the second position a lever system is employed in conjunction with the clockwork motor 52 and pull cord 54. A first lever 68 is pivotally mounted on an upright member 70 fixed to base plate 62 at a position intermediate the clockwork motor 52 and support brackets 66 of permanent magnet 20. Lever 68 is provided with an aperture 72 therein at one end through which the pull cord 54 passes, and at the other end is pivotally connected to a second lever 74. The second lever 74 is pivotally connected to a circular plate 76 which is fixed to a spindle 78 of permanent magnet 20. Hence, pivoting movement of the first lever 68 is converted to a pivoting movement of the circular plate 76 and therefore of permanent magnet 20. Pivoting movement of the first lever 68 is effected by a bead 78 fixed to the pull cord 54. A small coil spring 79 is connected between the upright member 70 and approximately midway along the second lever 74. Spring 79 applies a biasing force to the lever system which tends to force the first lever 68 and the circular plate 76 in an anti-clockwise direction to the first position as shown in FIG. 5. However, when bead 78 reaches the position shown in broken outline shown in FIG. 6 it engages the end of the first lever 68 adjacent aperture 72 and as the pull cord 54 is wound onto the spool 60 by motor 52, the bead 78 forces the lever 68 to pivot in a clockwise direction to the second position illustrated in FIG. 6.

It will be appreciated that by pulling on the finger grip 58 a length of pull cord 54 may be pulled out through the hole 56 limited only by the amount of cord available on the spool 60 and the bead 78 which will stop at hole 56. The first lever 68 will not begin to pivot in a clockwise direction until it is engaged by the bead 78 after a predetermined time interval corresponding to the time it takes the clockwork motor 52 to wind in the pull cord 54 onto spool 60 after motor 52 is activated. Once lever 68 pivots clockwise to the second position shown in FIG. 6, the permanent magnet 20 also pivots to its second position to activate the respective permanent magnets 40 and 48, releasing the contents of the internal reservoir 12 of the doll and opening the doll's eyes 42. The opening of the doll's eyes catches the attention of the child and suggests that the baby doll has awoken and requires attention. The child's attention may also be drawn to the doll by incorporating a sound generating means 80 as shown in FIG. 6.

Sound generating means 80 comprises an audio transducer in the form of a small loudspeaker 82 mounted on the base plate 62, and an electronic circuit 84. A battery compartment 86 mounted on the base plate 62 houses one or more batteries to supply electrical power to the electronic circuit 84 and loudspeaker 82. The electronic circuit 84 incorporates a sound generating IC for generating one or more sounds via loudspeaker 82, such as, for example a crying sound and a laughing sound. First and second stationary electrical contacts 88 are mounted so as to make an electrical connection with a movable contact 90 connected to the spindle of the permanent magnet 20 in either its first or second positions respectively. Hence, when the magnet 20 is in its second position as shown in FIG. 6, the movable contact 90 makes an electrical connection with the stationary contact 88 to activate the electronic circuit 84.

Thus, for example, the sound generating IC may be activated to produce a crying sound at the same time or shortly after the magnet 20 reaches its second position in which the closure member 18 of the doll's internal reservoir is opened to allow liquid to escape so that the doll appears to wet itself. The attention of a child playing with the doll is therefore immediately drawn to the doll and it is alerted to the fact that the doll has wet itself. Hence, the doll will appear to wake up and start crying simultaneously, indicating to the child that it needs to be changed. The sound generating IC may be programmed to emit an intermittent crying sound in order to conserve battery power in the event that the doll is left unattended by the child for a period of time.

Clockwork motor 52 is preferably provided with a switch 92 similar to the kind of switch employed in musical jewellery boxes to activate/de-activate the clockwork mechanism when the lid of the jewellery box is opened/closed respectively. Switch 92 is spring biased so as to normally protrude above the false bottom 64 of the cot 22, but is concealed from view by a plate 94 which is hingedly connected to the cot 22 in the region of the head of the cot. Plate 94 will typically be covered by a cushion or mattress provided in the cot 22 for the doll 10. The weight of plate 94 and the cushion/mattress by itself is insufficient to depress the switch 92. However, when the doll 10 is placed in the cot the additional weight of the doll's head and/or torso will cause the switch 92 to be depressed, which in turn activates the clockwork motor 52. Switch 92 is also connected to an electrical switch (not illustrated) for connecting and disconnecting the supply of electrical power to electronic circuit 84.

A typical sequence of the operation of the doll 10 co-operating with cot 22 will now be described in detail.

Initially, a child may elect to feed the doll 10 from a toy feeding bottle through its mouth 14 so as to fill or partially fill the internal reservoir 12. The child will also meanwhile have pulled the pull cord 54 through hole 56 by pulling on finger grip 58 in order to wind up the clockwork motor 52.

Clockwork motor 52 will remain in its wound-up condition until such time as the child places the doll 10 in cot 22. When this occurs, switch 92 is depressed and motor 52 is activated to start winding the pull cord 54 onto the spool 60. Eventually, (depending on how much of the cord 54 the child has pulled through hole 56), the actuating mechanism 50 will pivot the permanent magnet 20 from its first position to the second position in which the magnetic field causes the closure member 18 to move to its open position and the eyes 42 of the doll are opened. The baby doll 10 will therefore appear to have wet itself due to the flow of water through tube 16, and the sound generating IC of electronic circuit 84 will simultaneously be activated to produce a crying sound. This immediately draws the attention of the child to the doll which now has its eyes wide open indicating to the child that it is awake and is needing attention. As the doll is lifted out of the cot 22, the switch 92 moves upward to de-activate the motor 52 and the electronic circuit 84 of the sound generating means 80.

From the above description of a preferred embodiment of the baby doll 10 and cot 22 it will be apparent that the doll co-operates with the cot to simulate a baby wetting itself and invites the active involvement of a child playing with the doll. The active involvement of the child in feeding the doll, together with the sounds produced and the bed-wetting mechanism greatly enhance the play value of the doll. Also, it will be seen that by placing the actuating mechanism and sound generating means within the base of the cot 22, the internal mechanism for the doll can be kept within relatively small dimensions.

Numerous variations and modifications will suggest themselves to persons skilled in the relevant arts, in addition to those already described, without departing from the basic inventive concepts. For example, clockwork motor 52 need not be wound up by a pull cord as in the described embodiment, but may be provided with a small winding key which protrudes below the base plate 62 beneath the cot as with a musical jewellery box. If desired, clockwork motor 52 can also be arranged to play a tune, for example a lullaby to help the doll go to sleep. This has the advantage that it helps the child to remember to pull on finger grip 58 prior to placing the doll 10 in cot 22. Alternatively, the magnetic field generating means need not be a permanent magnet, but may be a stationary electromagnet which is activated by an electric current from a battery in response to an electric signal produced by a control circuit after a predetermined time interval. All such variations and modifications are to be considered within the scope of the present invention, the nature of which is to be determined from the foregoing description and the appended claims.

I claim:

1. A baby doll and a receptacle adapted to receive the doll in a recumbent position, the doll having:

an internal reservoir that can be filled with liquid through a mouth of the doll, said internal reservoir having an outlet which is closable by a closure member, said closure member being movable from a closed position to an open position in response to an applied magnetic field; and, the receptacle being provided with:

a magnetic field generating means, wherein said magnetic field generating means is movable between a first position in which the magnetic field is not applied to the closure member and a second position in which the magnetic field is applied to the closure member; and an actuating mechanism for automatically moving the magnetic field generating means from the first position to the second position after a certain time interval after the doll is placed in the receptacle;

whereby, in use, when the doll is placed in the receptacle and a magnetic field is applied to the closure member by the magnetic field generating means said outlet is opened so that the doll appears to have wet itself.

2. A baby doll and a receptacle as defined in claim 1, wherein said actuating mechanism comprises a clockwork motor that is wound-up by pulling on a pull cord and which unwinds within a predetermined time interval, towards the conclusion of which it moves the magnetic field generating means from the first position to the second position.

3. A baby doll and a receptacle as defined in claim 2, wherein a switch is provided for activating said clockwork motor when the doll is placed in the receptacle in a recumbent position.

4. A baby doll and a receptacle as defined in claim 3, wherein the receptacle is in the form of a cot.

5. A baby doll and a receptacle as defined in claim 4, wherein the cot also includes sound generating means for producing a crying sound a predetermined time interval after the magnetic field generating means has moved to the second position whereby, in use, the doll appears to cry because it has wet itself.

6. A baby doll and a receptacle as defined in claim 5, the doll further comprising movable eyes that close when it is placed in a recumbent position, said eyes being adapted to open when a magnetic field is applied thereto whereby, in use, when the doll is placed in the cot and a magnetic field is applied to the eyes by the magnetic field generating means the doll also appears to wake up because it has wet itself.

7. A baby doll and a receptacle as defined in claim 1, wherein said magnetic field generating means is a permanent magnet, pivotally mounted so that in the first and second positions opposite poles respectively of the permanent magnet are facing said closure member.

8. A baby doll and a receptacle as defined in claim 2, wherein the receptacle is in the form of a cot.

9. A baby doll and a receptacle as defined in claim 1, wherein the receptacle is in the form of a cot.

10. A baby doll and a receptacle as defined in claim 8, wherein the doll also includes sound generating means for producing a crying sound a predetermined time interval after the magnetic field generating means has moved to the second position whereby, in use, the doll appears to cry because it has wet itself.

11. A baby doll and a receptacle as defined in claim 9, wherein the doll also includes sound generating means for producing a crying sound a predetermined time interval after the magnetic field generating means has moved to the second position whereby, in use, the doll appears to cry because it has wet itself.

12. A baby doll and a receptacle as defined in claim 4, wherein the doll also includes sound generating means for producing a crying sound a predetermined time interval after the magnetic field generating means has moved to the second position whereby, in use, the doll appears to cry because it has wet itself.

13. A baby doll and a receptacle as defined in claim 8, wherein the cot also includes sound generating means for producing a crying sound a predetermined time interval after the magnetic field generating means has moved to the second position whereby, in use, the doll appears to cry because it has wet itself.

14. A baby doll and a receptacle as defined in claim 9, wherein the cot also includes sound generating means for producing a crying sound a predetermined time interval after the magnetic field generating means has moved to the second position whereby, in use, the doll appears to cry because it has wet itself.

* * * * *